US006367294B1

(12) United States Patent
Pauley

(10) Patent No.: US 6,367,294 B1
(45) Date of Patent: Apr. 9, 2002

(54) MAILBOX LOCKS, MAILBOX LOCKING SYSTEMS, AND LOCKING MAILBOXES

(76) Inventor: John F. Pauley, 4119 NE. 88th St., Vancouver, WA (US) 98665

( * ) Notice: Subject to any disclaimer, the term of this patent is extended or adjusted under 35 U.S.C. 154(b) by 0 days.

(21) Appl. No.: 09/430,061

(22) Filed: Oct. 29, 1999

(51) Int. Cl.[7] ..... B65D 55/14; E05B 65/48; E05B 65/52

(52) U.S. Cl. ..... 70/63; 70/106

(58) Field of Search ..... 70/63, 106, 159–162, 70/478; 232/23

(56) References Cited

U.S. PATENT DOCUMENTS

| | | | | | |
|---|---|---|---|---|---|
| 2,108,440 | A | | 2/1938 | Murphy | 70/81 |
| 4,000,847 | A | | 1/1977 | Duis | 232/35 |
| 4,382,540 | A | * | 5/1983 | Kelly et al. | 232/17 |
| 4,416,413 | A | | 11/1983 | Chester | 232/24 |
| 4,461,160 | A | * | 7/1984 | Van Gompel | 70/100 |
| 4,703,635 | A | * | 11/1987 | Wyatt | 70/63 |
| 4,726,512 | A | | 2/1988 | White | 232/17 |
| 5,082,169 | A | * | 1/1992 | Aurness et al. | 232/17 |
| 5,407,126 | A | | 4/1995 | Coultas et al. | 232/17 |
| 5,476,220 | A | | 12/1995 | Cohoon | 232/17 |
| 5,586,718 | A | | 12/1996 | Speece | 232/17 |
| 5,645,215 | A | | 7/1997 | Marendt et al. | 232/17 |
| 5,692,674 | A | | 12/1997 | Wicker | 232/17 |

* cited by examiner

*Primary Examiner*—Lynne H. Browne
*Assistant Examiner*—John B. Walsh
(74) *Attorney, Agent, or Firm*—Klarquist Sparkman, LLP

(57) ABSTRACT

Mailbox locks and mailboxes comprising such locks are disclosed. The lock includes a key lock mechanism and a strike bar that can be mounted on exterior surfaces of a housing and a door that defines an interior volume into which mail is deposited. In an embodiment, the key lock mechanism includes a key lock cover plate defining a slot for mounting the key lock mechanism to the door with screws or other fasteners inserted through the door and into the slot. Sliding the key lock mechanism along the slot permits alignment of the key lock mechanism. The strike bar also defines a respective slot. The strike bar also defines a locking cavity and an opening cavity such that, with the lock in a locked position, a bolt of the key lock mechanism can be captured by the locking cavity so that the door can be opened only by unlocking the lock. Whenever the bolt is engaged in an opening cavity, the door is readily openable without a key.

32 Claims, 8 Drawing Sheets

MAILBOX LOCKS, MAILBOX LOCKING SYSTEMS, AND LOCKING MAILBOXES

FIELD OF THE INVENTION

The invention pertains to mailbox locks and locking mailboxes.

BACKGROUND

The security of mail delivery is limited by the lack of security offered by conventional mailboxes. A conventional mailbox is readily opened so that mail deposited within is easily retrievable by anyone with access to the mailbox, including vandals, thieves, passers-by, as well as friends and relatives. For some businesses and individuals, mailbox security is so lacking that the intended recipients elect to have important mail (e.g., mail bearing credit card numbers and other important identification numbers) directed to an alternate location such as a Post Office box. In other cases, mail recipients insist that payroll, pension, or social security checks be deposited directly in the recipient's bank account, so that only a confirmation of deposit is mailed to an insecure mailbox. Mailbox vandalism and thefts from mailboxes are particularly serious problems in rural or other sparsely populated areas, and secure mailboxes for these locations are especially needed.

One way to reduce mail theft is to use a locking mailbox. For example, in multi-family dwellings, a mail carrier is often provided with a key to open a panel that contains an array of individual mailboxes, one for each family mail recipient. After delivering mail to the individual mailboxes, the mail carrier closes and locks the panel. The individual mailboxes are accessible by the respective families using individual keys and the mail is secure. Unfortunately, locking mailboxes of this type are unsuitable for single-family residences because the mail carrier must carry a key and unlock a mailbox to deliver mail to each residence, greatly increasing the time required to deliver the mail.

Other mailbox locks and locking mailboxes are disclosed in, for example, Murphy, U.S. Pat. No. 2,108,440; Marendt et al., U.S. Pat. No. 5,645,215; Wicker, U.S. Pat. No. 5,692,674; Speece, U.S. Pat. No. 5,586,718; and Coultas et al. U.S. Pat. No. 5,407,126. These mailbox locks tend to be insecure, expensive, require special tools for installation, or are difficult to install. Therefore, improved mailbox locks and locking mailboxes are needed.

SUMMARY OF THE INVENTION

According to one aspect of the invention, mailbox locks are provided comprising a lock mechanism and a strike bar, both adapted for mounting the lock to a mailbox. In one representative embodiment, the lock mechanism includes a handle and a bolt guide connected to the handle. A locking plate, rotatable by a lock, is situated to inhibit the motion of a bolt guide in which a bolt slides. The locking plate restrains the bolt guide and the handle whenever the lock is in a locked position so that the handle cannot be used to move the bolt, but the bolt remains slidable within a sliding range determined by the bolt guide. The strike bar defines an opening cavity and a locking cavity that can be situated to receive the bolt. In the locked position of the lock, the bolt is restrained by the locking cavity while the bolt is slidable into and out of the opening cavity by sliding within the bolt guide.

In another embodiment, the mailbox lock also includes a mounting plate for the lock mechanism. The mounting plate defines a slot that receives screws or analogous fasteners for securing the lock assembly to a mailbox, and the lock mechanism is slidable along the mounting slot to position the lock mechanism with respect to the strike bar. In yet another embodiment, the strike bar defines a slot that receives screws or analogous fasteners for securing the strike plate to a mailbox so that the strike bar is slidable along the mounting slot.

The lock mechanism can include a spring or analogous means that urges the bolt toward the strike bar. A guard plate can be situated between the bolt and a surface of a mailbox to which the key lock mechanism is mounted. In addition, a pin or the like can be attached to the bolt, wherein a slot is defined in the bolt guide to receive the pin and define the sliding range of the bolt.

A lockable mailbox according to the invention can comprise a housing having an interior surface and an exterior surface and defining an interior volume. A movable door is provided to close the interior volume defined by the housing. A mailbox lock as summarized above is attached to the housing and the door. In some embodiments, the strike bar is attached to the housing and the lock mechanism is attached to the door. In other embodiments, the strike bar is attached to the door and the lock mechanism is attached to the housing. In additional embodiments, the lock mechanism and the strike bar are attached to exterior surfaces of the door and the housing.

These and other features of the invention are described in the following detailed description that proceeds with reference to the accompanying drawings.

DETAILED DESCRIPTION

Figure 1:
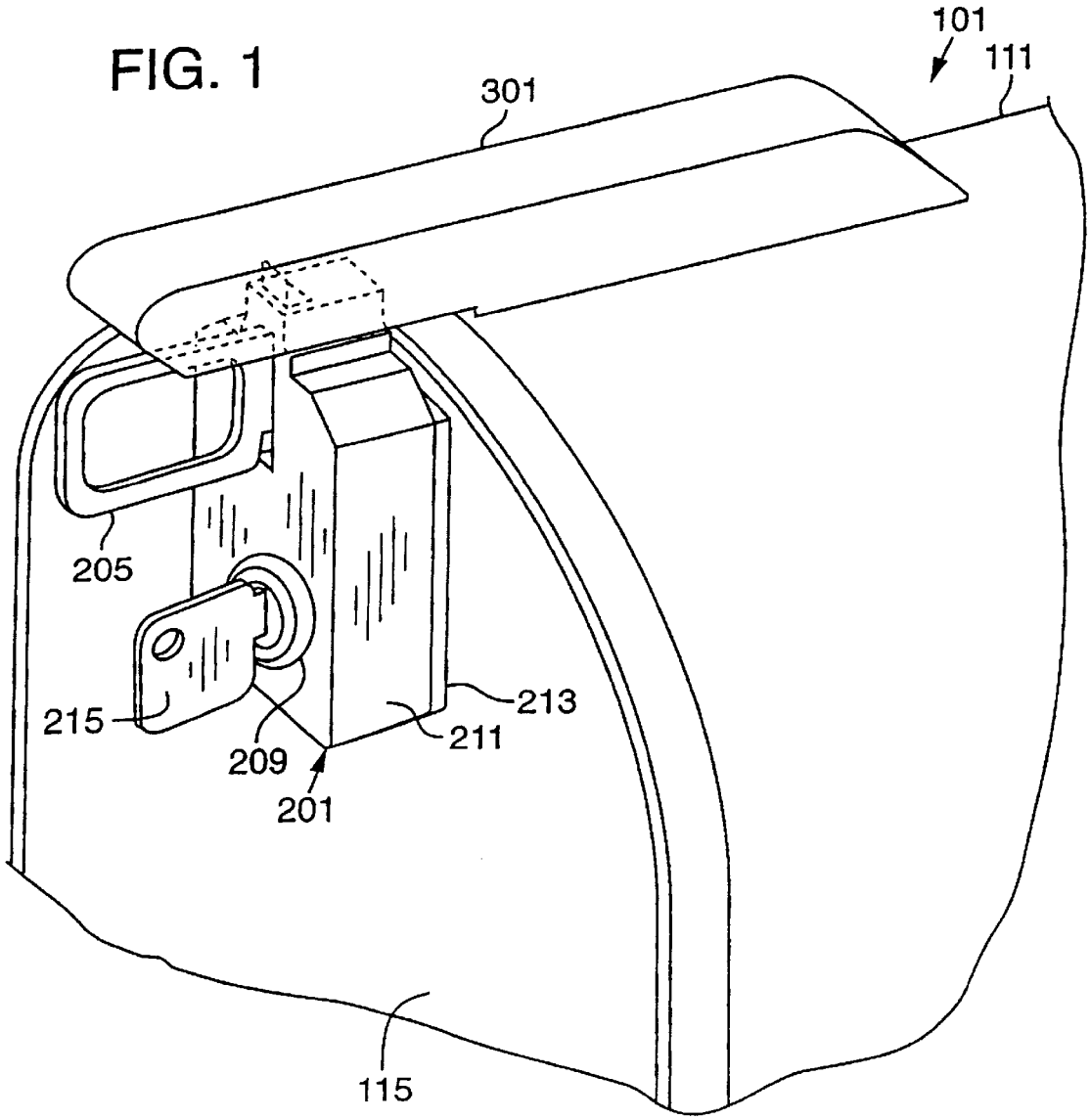
FIG. 1 is a perspective view of a portion of a locking mailbox according to the invention.

FIG. 1 shows a portion of a first representative embodiment of a locking mailbox 101 according to the invention. The mailbox 101 includes a housing 111 defining an interior volume and a door 115 that closes the interior volume. The mailbox 101 includes a lock comprising a strike bar 301, attached to an exterior surface of the housing 111, and a lock mechanism 201 attached to an exterior surface of the door 115. The lock mechanism 201 includes a handle 205 and a cylinder lock 209 that are mounted to a housing 211 and a housing cover plate 213. The key lock mechanism is shown in FIG. 1 with a key 215 inserted into the cylinder lock 209.

Figures 2, 3:
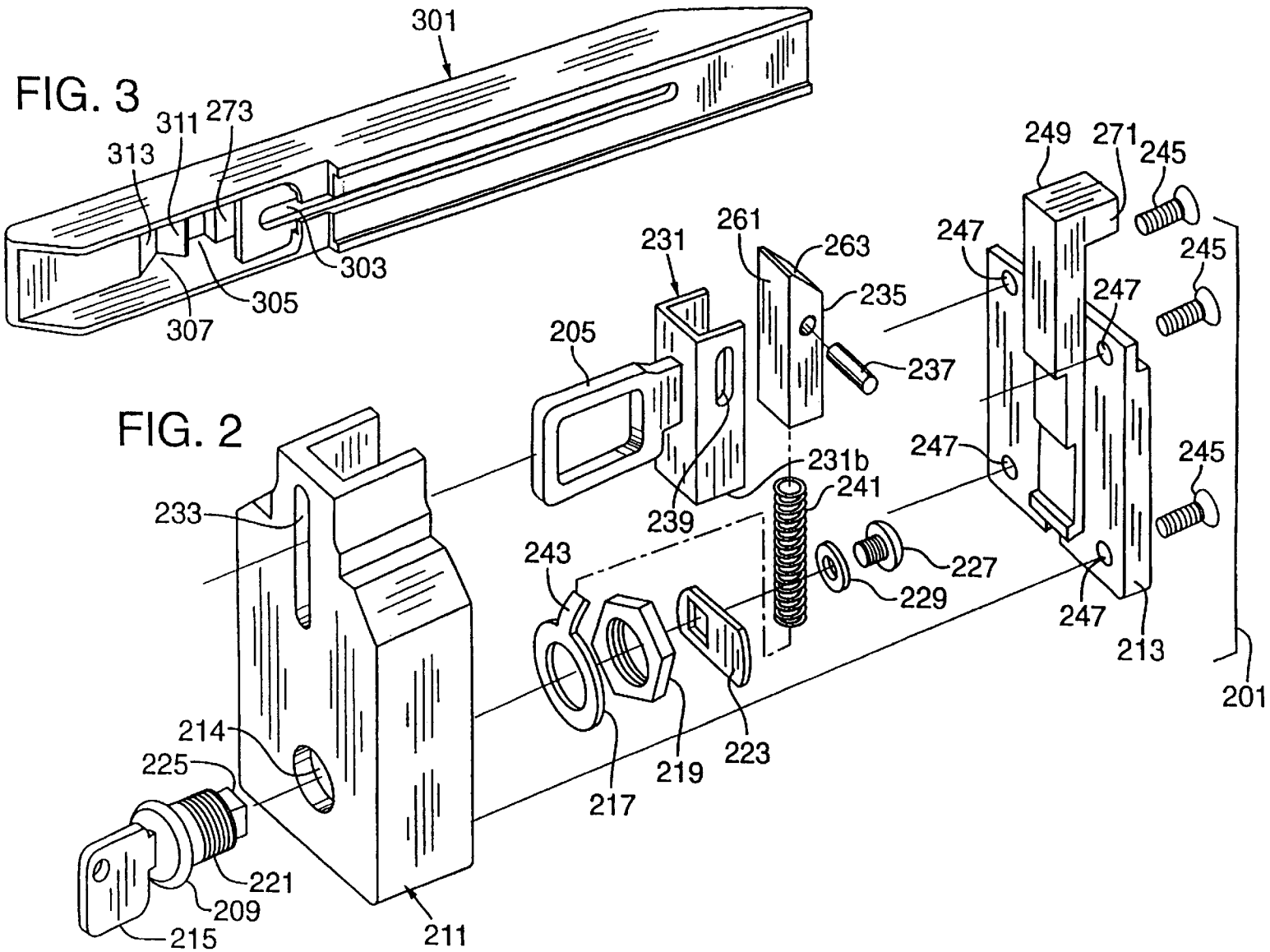
FIG. 2 is an exploded view of a lock mechanism.
FIG. 3 is a perspective view of a strike bar.

FIG. 2 shows the lock mechanism 201 in greater detail. The cylinder lock 209 extends into a bore 214 in the housing 211 and is fastened to the housing 211 with a washer 217 and a nut 219 that screw onto a threaded region 221 of the cylinder lock 209. A locking tab 223 fits onto a square or analogously profiled end 225 of the cylinder lock 209 and is secured with a screw 227 and a washer 229. Thus, the locking tab 223 rotates whenever the key 215 (inserted fully into the cylinder lock 209) is turned.

The handle 205 attaches to a bolt guide 231 and extends through a slot 233 defined by the housing 211. A bolt 235 fits into the bolt guide 231 and is retained with a pin 237 inserted in a slot 239 defined in the bolt guide 231. A spring 241 fits over an extension tab 243 of the washer 217 and contacts the bolt 235 to urge the bolt 235 away from the extension tab 243. The housing cover plate 213 is attached to the housing 211 with screws 245 that extend through holes 247. A guard plate 249 attaches to the housing cover plate 211.

Figure 4:
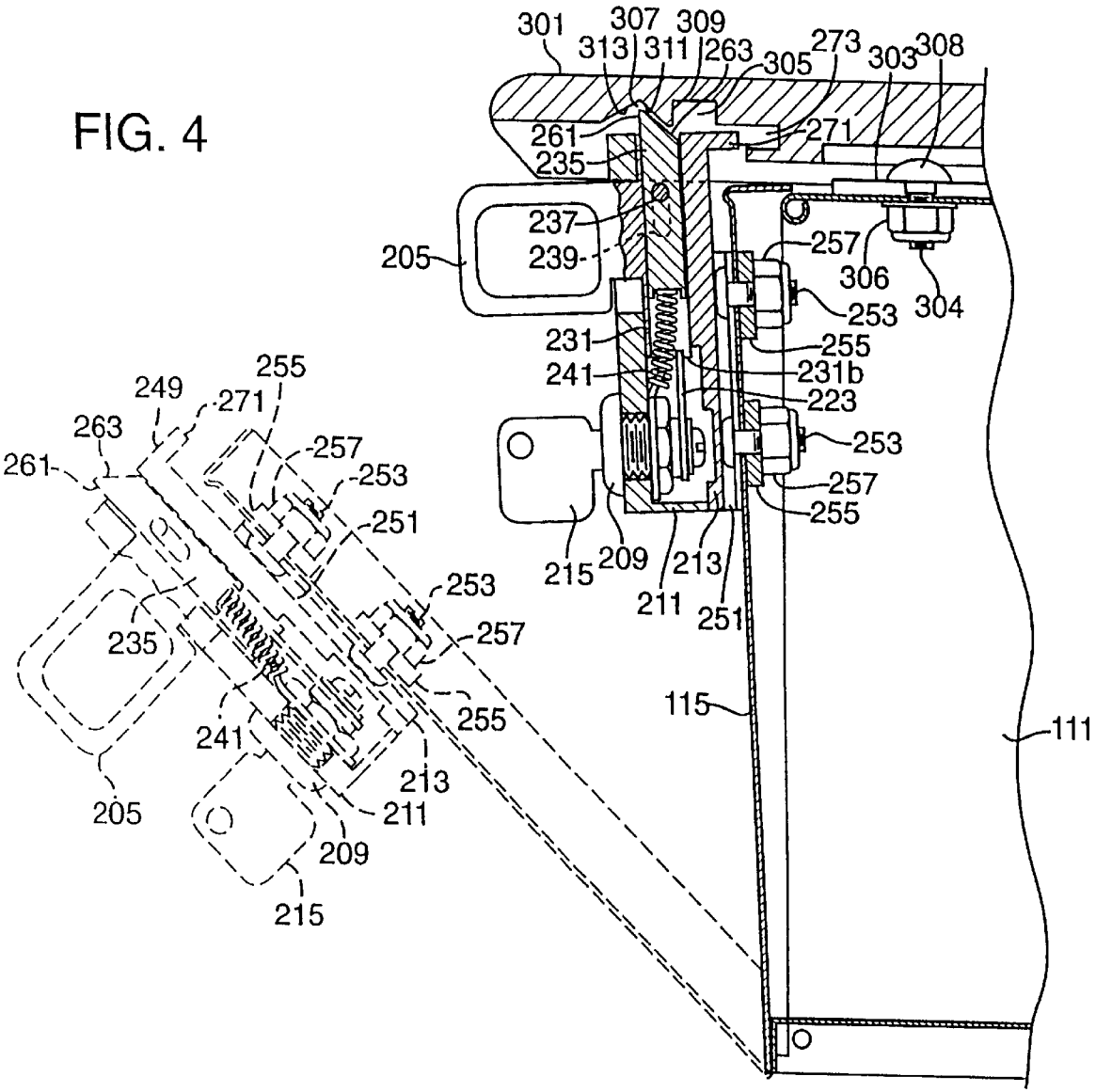
FIG. 4 contains partial sectional views of the locking mailbox of FIG. 1, showing the mailbox in an open position and in an openable position.

FIG. 4 shows the attachment of the lock mechanism 201 to the door 115. The housing cover plate 213 defines a slot 251 into which screws 253 extend through the door 115 and backing plates 255. The lock mechanism 201 is secured with nuts 257 threaded onto the screws 253. With the nuts 257 slightly loosened, the lock mechanism 201 is slidable along the slot 251, permitting the lock mechanism 201 to be properly positioned with respect to the strike bar 301. To install the lock mechanism 201 on a mailbox having a conventional (non-locking) latch, the latch is removed so that holes used to attach the conventional latch are available for mounting the lock mechanism 201. The screws 253 are inserted through the existing holes, and no additional holes are necessary. A standard wrench can be used to tighten the screws 253 and the nuts 257. Thus, attachment of the lock mechanism 201 to the door is simple and requires neither special tools nor drilling additional holes in the door 115.

The strike bar 301 is illustrated in greater detail in FIGS. 3–4. The strike bar 301 defines a mounting slot 303 into which mounting screws 304 are inserted. If necessary to fit into the mounting slot 303, screw heads 308 of the screws 304 can be machined to be rectangular or the like, in which a narrow dimension of the screw heads 308 fits into the mounting slot 30. The mounting screws 304 pass through mounting holes in the housing 111 to fix the strike bar 301 to the housing 111 using nuts 306. The mounting holes in the housing 111 are generally made available by removing any pre-existing latch mechanism from the housing 111, and drilling new holes is generally unnecessary. After the screw heads 308 are inserted, the screw heads 308 are rotated to urge the strike bar 301 towards the housing 111 as the nuts 306 are tightened. The mounting slot 303 permits sliding the strike bar 301 with respect to the housing 111 to align the strike bar 301 with the housing 111 and with the lock mechanism 201. The nuts 306 are tightened with a standard wrench, but wing-nuts or other fasteners can be used. If the nuts 306 are sufficiently tight, then the strike bar 301 cannot be removed without a wrench, discouraging theft of the lock 101. Thus, attachment and adjustment of the strike bar 301 is simple, requiring inserting the screws 304 into pre-existing holes in the housing 111, sliding the strike bar 301 into alignment with the screws 304 in the slot 303, and tightening the nuts 306 onto the screws 304.

The strike bar 301 defines a locking cavity 305 and an opening cavity 307. As explained below, with the key 215 inserted into the cylinder lock 209 and turned to a "locked" position, the door 115 is locked if the bolt 235 is captured by the locking cavity 305 and openable (without using the key) if the bolt 235 is captured by the opening cavity 307. As shown in FIG. 4, the locking cavity 305 has a rectangular cross section and includes a surface 309 that is approximately parallel to a surface 261 of the bolt 235 whenever the lock mechanism 201 and the strike bar 301 are mounted to the door 115 and the housing 111, respectively, and the door 115 is in a fully closed position. A surface 311 of the opening cavity 307 is profiled such that the surface 311 is approximately parallel to the surface 263 of the bolt 235 whenever the bolt 235 is engaged in the locking cavity 305. A surface 313 is tilted with respect to the surface 261 of the bolt 235 so that the bolt 235 can slide out of the opening cavity 307 whenever the handle 205 is pulled in a manner serving to open the door 115.

Figure 5:
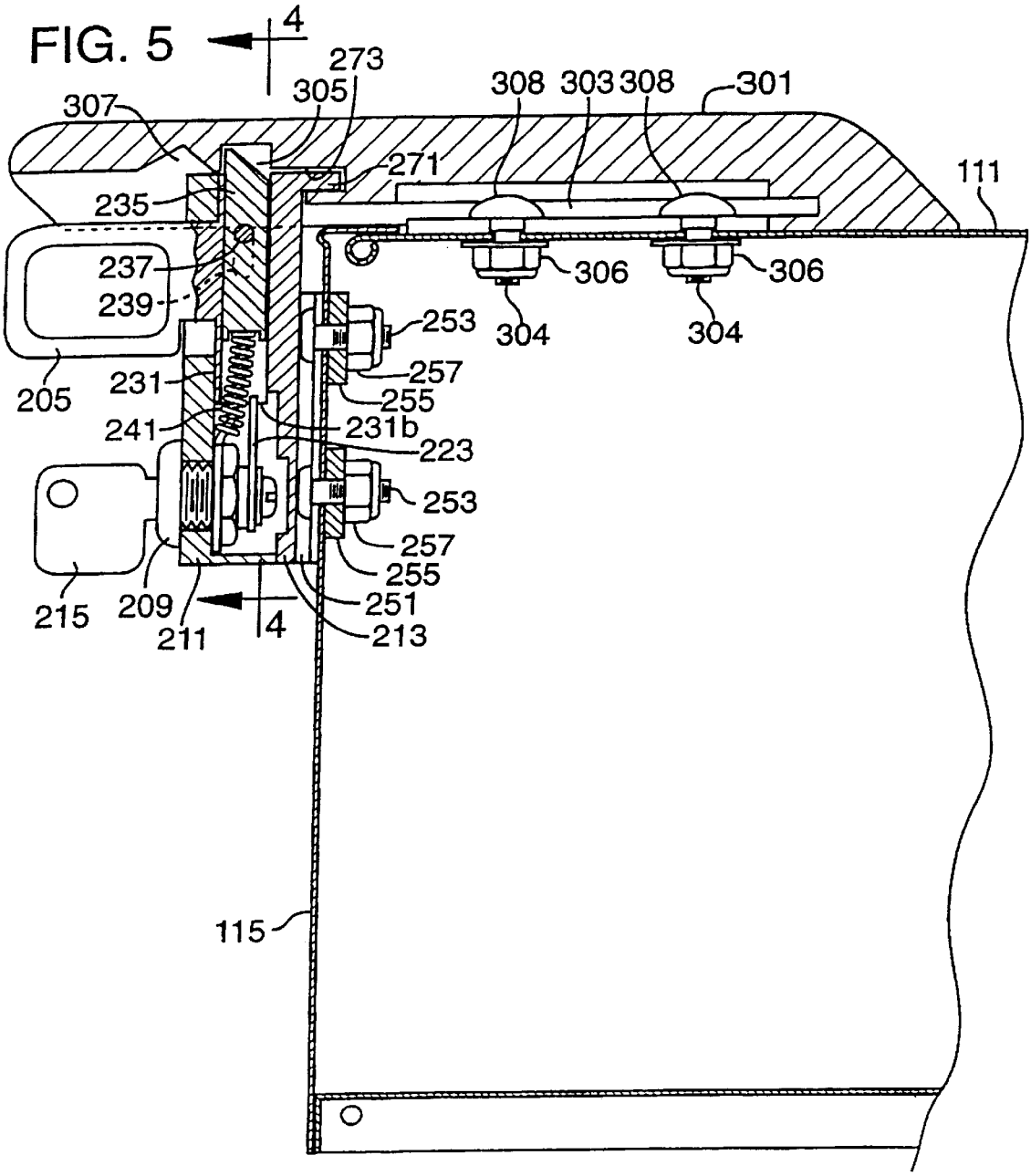
FIG. 5 is a partial sectional view of the locking mailbox of FIG. 1, showing the mailbox in a locked position.

FIGS. 4–5 illustrate the operation of the mailbox 101. Whenever the key 215 is turned such that the cylinder lock 209 is in a "locked" position, the locking tab 223 engages the underside 231*b* of the bolt guide 231. Such engagement arrests any significant downward movement of the bolt guide 231 and thus prevents disengagement of the bolt 235 from the locking cavity 305 by using the handle 205.

Whenever the key 215 is turned so that the cylinder lock 209 is in an "unlocked" position, the locking tab 223 does not engage the underside 231*b* of the bolt guide 231. If the bolt 235 is engaged in the locking cavity 305, the door 115 can be opened by the operator grasping the handle 205 and pulling downward to disengage the bolt 235 from the locking cavity 305. I.e., the handle 205 can be used to move the bolt 235 downward over a range limited by the length of the slot 233.

With the cylinder lock 209 in either a "locked" or "unlocked" position, the door 115 can be closed so that the bolt 235 is captured by either the opening cavity 307 (see FIG. 4) or the locking cavity 305 (see FIG. 5). (When closing the door, the bolt 235 first engages the opening cavity 307, then the locking cavity 305. Both events readily can be sensed by the operator.) If the bolt 235 is in either of the cavities 305, 307, and the cylinder lock 209 is in the "unlocked" position, the door 115 can be opened. If the bolt 235 is in the locking cavity 305, then pulling the handle 205 downward causes the bolt 235 to slide downward out of the locking cavity 305. If the bolt 235 is in the opening cavity 307, then pulling the handle 205 away from the housing 111 causes the bolt 235 to slide against the surface 313, urging the bolt 235 out of the opening cavity 307 as the bolt 235 slides in the bolt guide 231.

When closing the door 115 with the cylinder lock 209 in either the locked or unlocked position, contact of the bolt 235 with the strike bar 301 causes the bolt 235 to slide downward in the bolt guide 231; thus, it is not necessary to grip the handle 205 to close and lock the door 115. Alternatively, when closing the door 115 with the cylinder lock 209 unlocked, the handle 205 can be pulled downward to prevent the bolt 235 from contacting the strike bar 301. Then, when the door 115 is fully closed, the handle 205 can be released. In either case, with the cylinder lock 209 unlocked, the door 115 can be opened or closed with the bolt 235 starting or ending in either of the cavities 305, 307, without using the key 215.

To prepare the mailbox 101 to receive mail and to allow subsequently received mail to be locked within the mailbox 101, the door 115 is opened so that the bolt 235 is not engaged in the locking cavity 305. The key 215 is turned so that the cylinder lock 209 is in a locked position (in which the locking tab 223 engages the underside 231*b* of the bolt guide 231). The door 115 is then moved to a partially closed position in which the bolt 235 engages the opening cavity 307. With the cylinder lock 209 locked, the locking tab 223 limits the range of motion of the handle 205 within the slot 233. (Hence, whenever the door 115 is fully closed such that the bolt 235 is engaged in the locking cavity 305, the bolt 235 cannot be disengaged from the locking cavity 305 using the handle 205.) However, the bolt 235 remains movable relative to the bolt guide 231 within a range determined by the slot 239, and pulling the handle 205 away from the housing 111 causes the bolt 235 to slide against the surface 311 and out of the opening cavity 307, thereby opening the mailbox 101. Thus, even though the lock 209 is in a locked position and the door 115 nearly closed, the mailbox 101 is still openable without a key, allowing the mail carrier to open the mailbox 101 and deposit mail.

After depositing mail in the mailbox 101, the mail carrier fully closes the door 115 so that the bolt 235 slides through the opening cavity 307 and into the locking cavity 305. I.e., although the spring 241 urges the bolt 235 into the opening cavity 307, the surfaces 311, 313 permit the bolt 235 to slide through the opening cavity 307. When the door 115 is fully closed so that the bolt 235 is engaged in the locking cavity 305, the spring 241 urges the bolt 235 into the locking cavity 305 and the mailbox 101 is locked. If the bolt 235 is captured by the cavity 305 and the cylinder lock 209 is in the locked position, the mailbox cannot be opened without the key 215. This is because the handle 205 is prevented by the locking tab 223 from sliding in the slot 233; thus the handle 205 alone cannot be used to disengage the bolt 235 from the locking cavity 305. Under such conditions, pulling the handle 205 merely urges the surface 261 of the bolt 235 against the surface 309. Because the surface 309 is approximately parallel to the surface 261, pulling the handle 205 does not cause the bolt 235 to disengage from the locking cavity 305. Under such conditions, the mailbox 101 is locked and access to the mail inside is available only with the key 215.

With the mailbox 101 locked (i.e., the cylinder lock 209 in the locked position and the bolt 235 is engaged in the locking cavity 305), the bolt 235 can still move within the bolt guide 231, limited only by the strike bar 301 and the range of motion allowed by the pin 237 in the slot 239. Even though the spring 241 urges the bolt 235 into the locking cavity 305, an inserted object exerting downward pressure on the surface 263 could cause retraction of the bolt 235 from the locking cavity 305. The guard plate 249 hinders the insertion of objects between the door 115 and the bolt 235, thereby making it difficult to access the bolt 235 and to open the mailbox 101 without the key 215. In addition, when the mailbox 101 is locked, a guard plate projection 271 fits into a cavity 273.

The housing 111 is typically sheet metal or other deformable material, and a force applied to the strike bar 301 can deform the housing 111. The guard plate projection 271 is captured by the cavity 273 so that, even if the housing 111 is deformed, the strike bar 301 and the lock mechanism 201 do not separate. If the strike bar 301 and the lock mechanism 201 separate, then the bolt 235 and the cavity 305 could separate, permitting the door 115 to be opened without unlocking the cylinder lock 209.

The door 115 of the mailbox 101 is held closed by the lock mechanism 201 and the strike bar 301, and no additional closure mechanisms are needed. As shown in FIG. 1, the lock mechanism 201 and the strike bar 301 are attached to the door 115 and the housing 111, respectively. In other examples, the lock mechanism 201 can be attached to the housing 111 and the strike bar 301 attached to the door 115.

FIGS. 6–9 illustrate an alternative embodiment of a locking mailbox 601. The mailbox 601 is similar to the mailbox 101 but does not include a guard plate such as the guard plate 249. Similar components of the mailbox 601 and the mailbox 101 are labeled with the same reference numerals.

Figure 6:
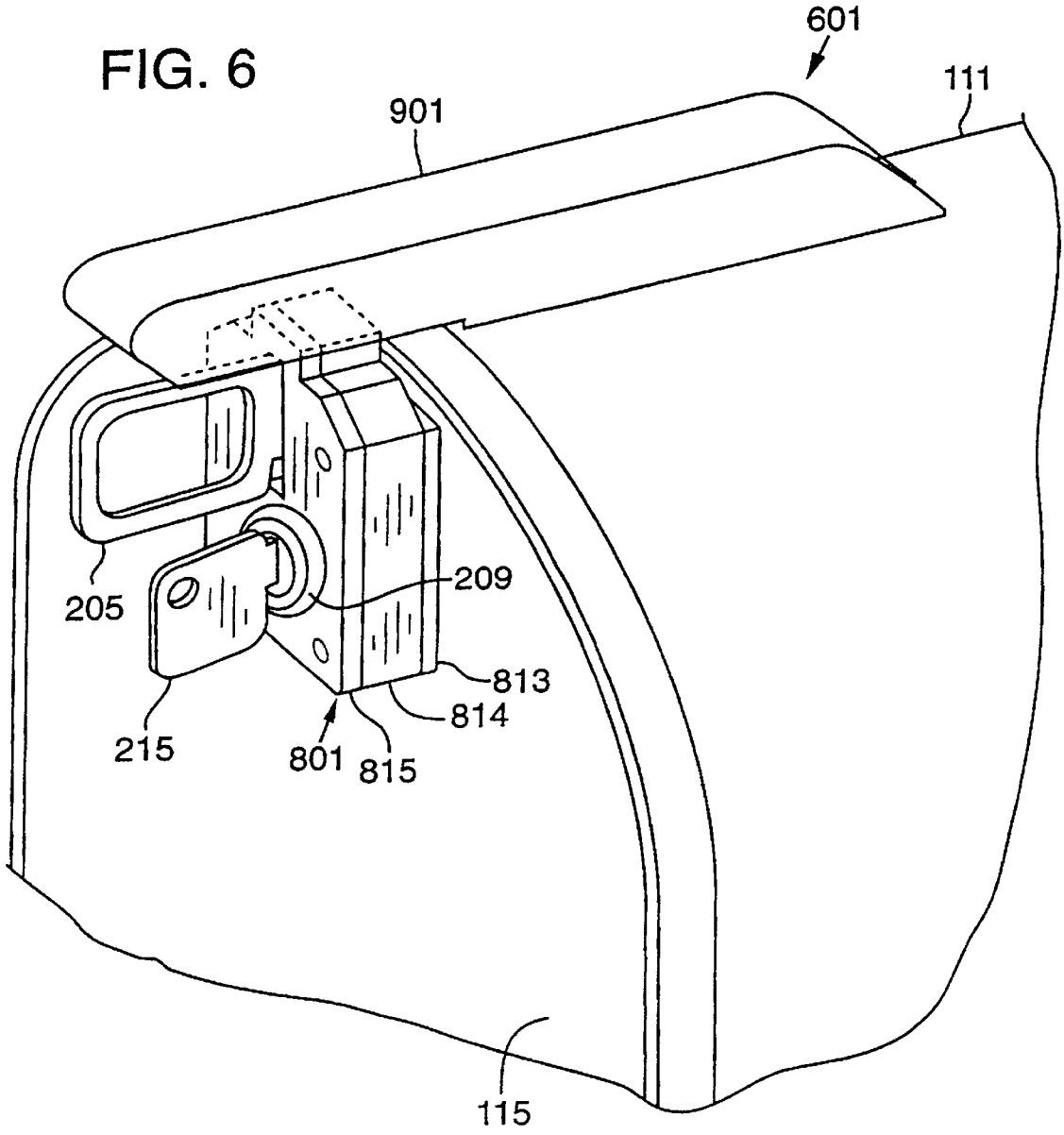
FIG. 6 is a perspective view of a portion of another embodiment of a locking mailbox according to the invention.
Figure 7:
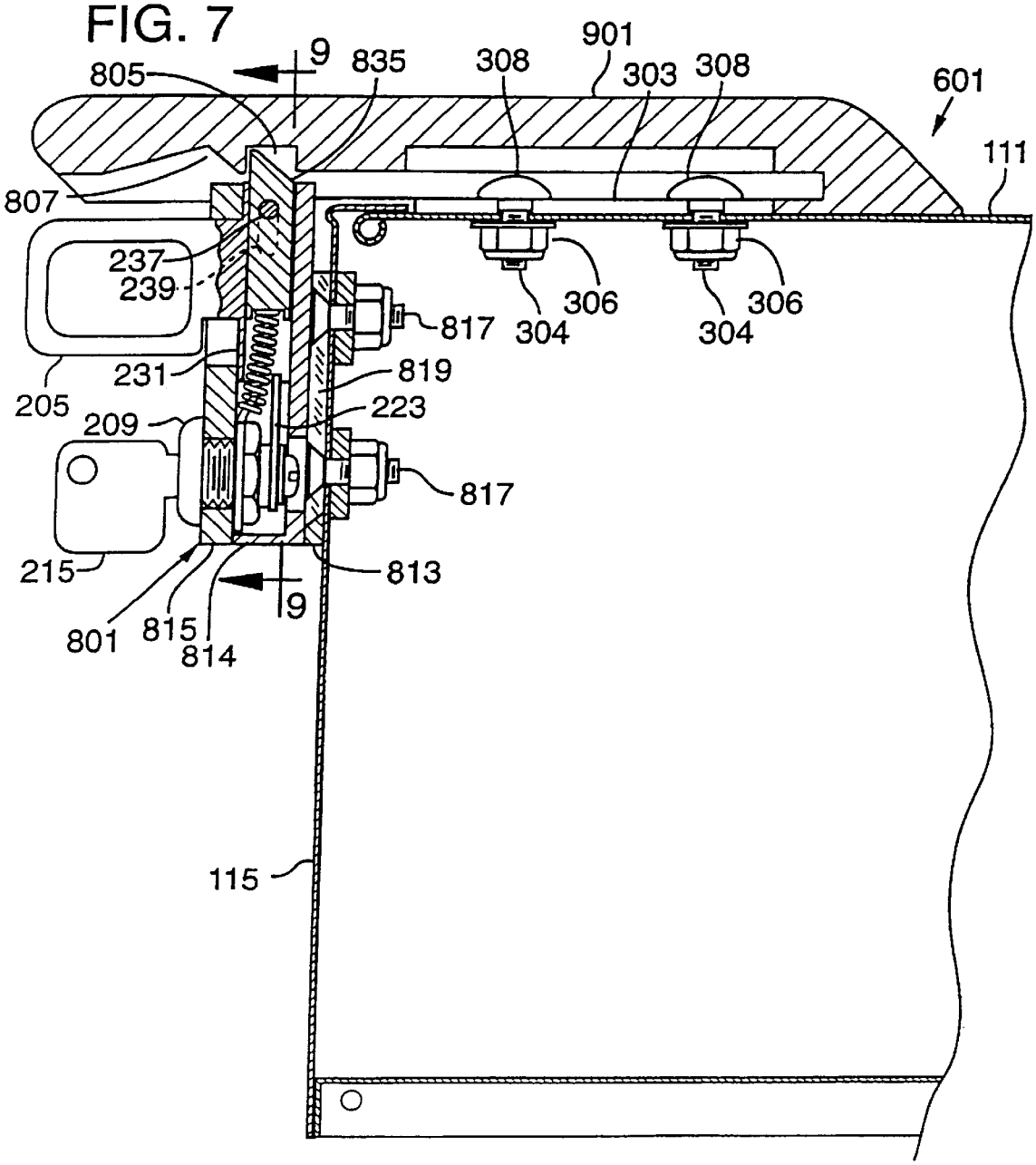
FIG. 7 is a partial sectional view of the locking mailbox of FIG. 6, with the mailbox in a locked position.

FIG. 6 shows a lock mechanism 801 and a strike bar 901 attached to the door 115. The lock mechanism 810 includes housing cover plates 813, 815 and a housing body 814. FIG. 7 shows the attachment of the lock mechanism 801 to the door 115 with screws 817 that are retained in a mounting slot 819 in the housing cover plate 813.

Figure 8:
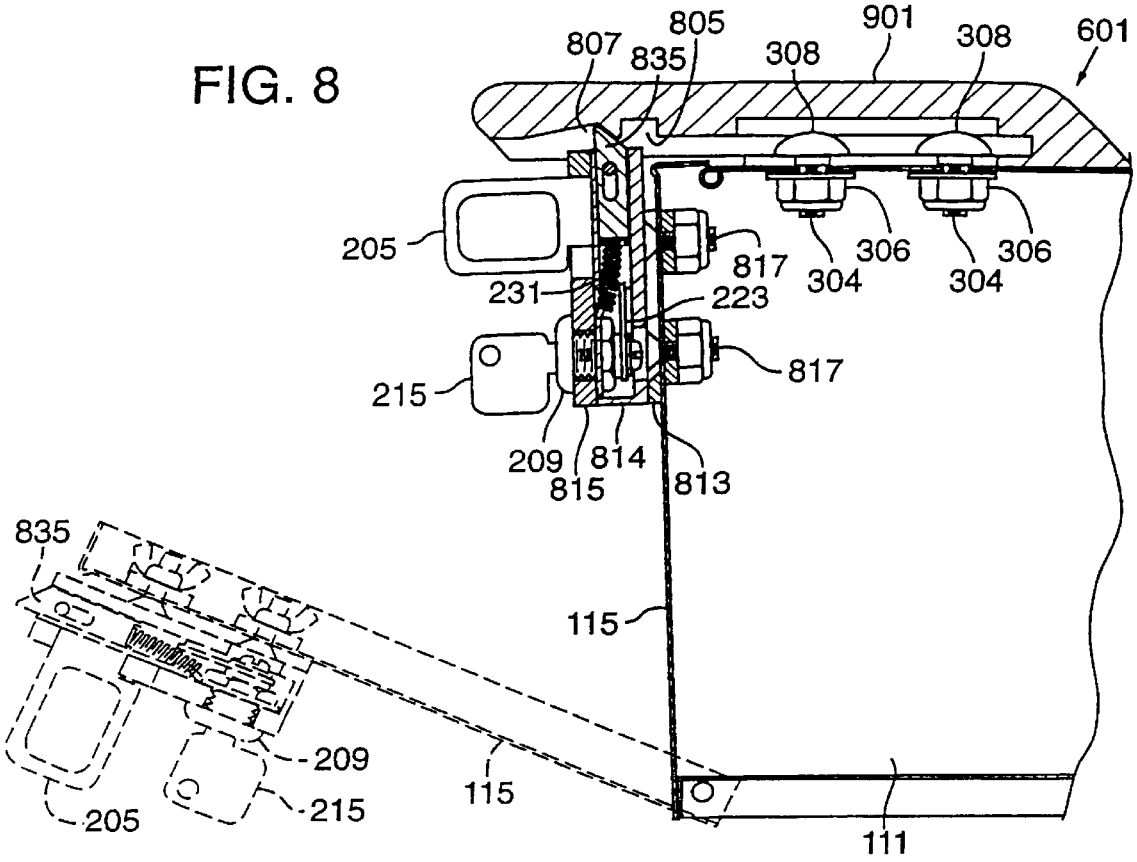
FIG. 8 contains partial sectional views of the mailbox of FIG. 6 showing the mailbox in an open position and in an openable position.
Figure 9:
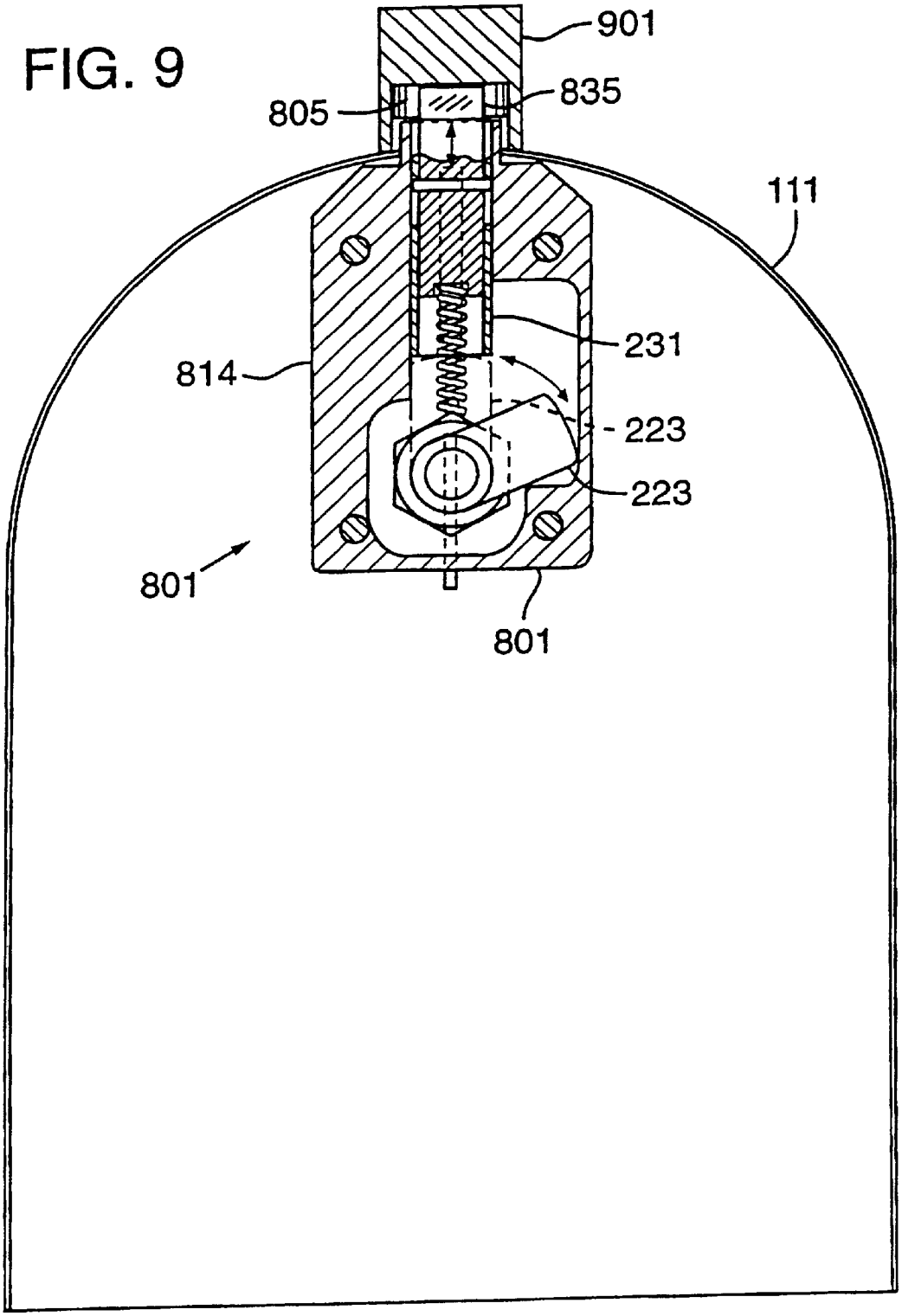
FIG. 9 is a sectional view of a lock mechanism mounted to the locking mailbox of FIG. 6.

FIG. 7 shows the lock mechanism 801 with a bolt 835 captured in a locking cavity 805 in the strike bar 901. The strike bar 901 includes an opening cavity 807, similar to the opening cavity 307 shown in FIG. 3. FIG. 8 shows the bolt 835 captured in the opening cavity 807 as well as showing the door 115 opened. FIG. 9 shows the mailbox 601 to illustrate the rotation of the locking tab 223 by the lock 209 to either engage or disengage the bolt guide 231. The mailbox 601 lacks a guard plate such as the guard plate 249. In other respects, the mailbox 601 is similar to the mailbox 101, permitting secure delivery of mail without a key.

The invention is directed to novel and non-obvious aspects of this disclosure, both individually and in combination as set forth in the claims below.

I claim:

1. A mailbox lock, comprising:

a lock mechanism, adapted for mounting to a mailbox, the lock mechanism including a handle, a bolt, a lock, and a locking plate attached to the lock, the locking plate being configured and situated to engage and restrict movement of the handle whenever the lock is in a locked position; and a strike bar adapted for mounting to a mailbox exterior, the strike bar including an opening cavity and a locking cavity, the opening cavity and the locking cavity being situated to receive the bolt, wherein, in the locked position of the lock, the bolt is restrained by the locking cavity and the bolt is slidable into and out of the opening cavity.

2. A mailbox lock, comprising:

a lock mechanism, adapted for mounting to a mailbox, the lock mechanism including a handle, a bolt, a lock, and a locking plate attached to the lock, the locking plate being configured and situated to engage and restrict movement of the handle whenever the lock is in a locked position, wherein the lock mechanism includes a bolt guide attached to the handle, wherein the bolt is movable with respect to the bolt guide whenever the lock is in either the locked position or an unlocked positions; and a strike bar adapted for mounting to a mailbox, the strike bar including an opening cavity and a locking cavity, the opening cavity and the locking cavity being situated to receive the bolt, wherein, in the locked position of the lock, the bolt is restrained by the locking cavity and the bolt is slidable into and out of the opening cavity.

3. The mailbox lock of claim 2, wherein the lock mechanism includes a pin attached to the bolt and the bolt guide includes a slot that receives the pin, the slot and the pin defining a sliding range of the bolt with respect to the bolt guide.

4. A mailbox lock, comprising:

a lock mechanism, adapted for mounting to a mailbox, the lock mechanism including a handle, a bolt, a lock, and a locking plate attached to the lock, the locking plate being configured and situated to engage and restrict movement of the handle whenever the lock is in a locked position, wherein the lock mechanism defines a slot that receives fasteners for securing the lock mechanism to a mailbox, and allowing the lock mechanism to be positionally adjusted relative to the mailbox; and a strike bar adapted for mounting to a mailbox, the strike bar including an opening cavity and a locking cavity, the opening cavity and the locking cavity being situated to receive the bolt, wherein, in the locked position of the lock, the bolt is restrained by the locking cavity and the bolt is slidable into and out of the opening cavity.

5. A mailbox lock, comprising:

a lock mechanism, adapted for mounting to a mailbox, the lock mechanism including a handle, a bolt, a lock, and a locking plate attached to the lock, the locking plate being configured and situated to engage and restrict movement of the handle whenever the lock is in a locked position; and a strike bar adapted for mounting to a mailbox, the strike bar including an opening cavity and a locking cavity, the opening cavity and the locking cavity being situated to receive the bolt, wherein, in the locked position of the lock, the bolt is restrained by the locking cavity and the bolt is slidable into and out of the opening cavity, wherein the strike bar defines a slot that receives fasteners for securing the strike bar to a mailbox, and allowing the strike bar to be positionally adjusted relative to the mailbox.

6. The mailbox lock of claim 5, wherein the lock mechanism defines a slot that receives fasteners for securing the lock mechanism to a mailbox, the lock mechanism being slidable along the slot.

7. A mailbox lock, comprising:

a lock mechanism, adapted for mounting to a mailbox, the lock mechanism including a handle, a bolt, a lock, and a locking plate attached to the lock, the locking plate being configured and situated to engage and restrict movement of the handle whenever the lock is in a locked position; and a strike bar adapted for mounting to a mailbox, the strike bar including an opening cavity and a locking cavity, the opening cavity and the locking cavity being situated to receive the bolt, wherein, in the locked position of the lock, the bolt is restrained by the locking cavity and the bolt is slidable into and out of the opening cavity, wherein the lock mechanism includes a spring that urges the bolt toward the strike bar.

8. A mailbox lock, comprising:

a lock mechanism, adapted for mounting to a mailbox, the lock mechanism including a handle, a bolt, a lock, and a locking plate attached to the lock, the locking plate being configured and situated to engage and restrict movement of the handle whenever the lock is in a locked position, wherein the lock mechanism includes a mounting surface for mounting the lock mechanism to a mailbox, and a guard plate situated between the bolt and the mounting surface; and a strike bar adapted for mounting to a mailbox, the strike bar including an opening cavity and a locking cavity, the opening cavity and the locking cavity being situated to receive the bolt, wherein, in the locked position of the lock, the bolt is restrained by the locking cavity and the bolt is slidable into and out of the opening cavity.

9. A lockable mailbox, comprising:

a housing having an interior surface and an exterior surface and defining an interior volume;

a door movable to close the interior volume defined by the housing and having an exterior surface; and a mailbox lock as recited in claim 2 attached to the housing and the door.

10. The mailbox lock of claim 9, wherein the lock mechanism is mounted to the door and the strike plate is mounted to the housing.

11. The mailbox lock of claim 9, wherein the lock mechanism is mounted to the exterior surface of the door and the strike bar is mounted to the exterior surface of the housing.

12. A lockable mailbox, comprising:

a housing having an interior surface and an exterior surface and defining an interior volume;

a door movable to close the interior volume defined by the housing; and a mailbox lock as recited in claim 6.

13. The lockable mailbox of claim 12, wherein the lock mechanism is attached to the housing and the strike bar is attached to the door.

14. The lockable mailbox of claim 12, wherein the lock mechanism is attached to the door and the strike bar is attached to the housing.

15. The lockable mailbox of claim 12, wherein the lock mechanism is attached to the exterior surface of the door and the strike bar is mounted to the exterior surface of the housing.

16. The lockable mailbox of claim 12, wherein the lock mechanism is attached to the exterior surface of the housing and the strike bar is mounted to the exterior surface of the door.

17. A lockable mailbox, comprising:

(a) a housing;

(b) a door movably attached to the housing, the housing and the door defining an interior space, wherein the door is operable to provide access to the interior space;

(c) a lock mechanism, attached to the door, the lock mechanism including:

a handle;

a lock;

a locking plate, rotatable with the lock into an unlocked position or a locked position, and inhibiting the motion of the handle in the locked position;

a bolt guide connected to the handle;

a bolt, slidable along the bolt guide, wherein the bolt is movable by the bolt guide;

a spring situated to urge the bolt along the bolt guide; and a mounting plate defining a slot adapted to receive mounting fasteners for attaching the lock mechanism to the door;

(d) a strike bar that defines:

a locking cavity;

an opening cavity; and a slot adapted to receive mounting fasteners for attaching the strike bar to the housing; and (e) wherein the lock mechanism and the strike bar are slidable along the respective slots for positioning the bolt with respect to the strike bar.

18. The mailbox lock of claim 1, wherein the lock mechanism includes a bolt guide attached to the handle, wherein the bolt is movable with respect to the bolt guide whenever the lock is in either the locked position or an unlocked position.

19. The mailbox lock of claim 2, wherein the lock mechanism includes a pin attached to the bolt and the bolt guide includes a slot that receives the pin, the slot and the pin defining a sliding range of the bolt with respect to the bolt guide.

20. The mailbox lock of claim 1, wherein the lock mechanism defines a slot that receives fasteners for securing the lock mechanism to a mailbox, and allowing the lock mechanism to be positionally adjusted relative to the mailbox.

21. The mailbox lock of claim 1, wherein the strike bar defines a slot that receives fasteners for securing the strike bar to a mailbox, and allowing the strike bar to be positionally adjusted relative to the mailbox.

22. The mailbox lock of claim 21, wherein the lock mechanism defines a slot that receives fasteners for securing the lock mechanism to a mailbox, the lock mechanism being slidable along the slot.

23. The mailbox lock of claim 1, wherein the lock mechanism includes a spring that urges the bolt toward the strike bar.

24. The mailbox lock of claim 1, wherein the lock mechanism includes a mounting surface for mounting the lock mechanism to a mailbox, and a guard plate situated between the bolt and the mounting surface.

25. A lockable mailbox, comprising:

a housing having an interior surface and an exterior surface and defining an interior volume;

a door movable to close the interior volume defined by the housing and having an exterior surface; and a mailbox lock as recited in claim 1 attached to the housing and the door.

26. The mailbox lock of claim 25, wherein the lock mechanism is mounted to the door and the strike bar is mounted to the housing.

27. The mailbox lock of claim 25 wherein the lock mechanism is mounted to the exterior surface of the door and the strike bar is mounted to the exterior surface of the housing.

28. A lockable mailbox, comprising:

a housing having an interior surface and an exterior surface and defining an interior volume;

a door movable to close the interior volume defined by the housing; and a mailbox lock as recited in claim 22.

29. The lockable mailbox of claim 28, wherein the lock mechanism is attached to the housing and the strike bar is attached to the door.

30. The lockable mailbox of claim 28, wherein the lock mechanism is attached to the door and the strike bar is attached to the housing.

31. The lockable mailbox of claim 28, wherein the lock mechanism is attached to the exterior surface of the door and the strike bar is mounted to the exterior surface of the housing.

32. The lockable mailbox of claim 28, wherein the lock mechanism is attached to the exterior surface of the housing and the strike bar is mounted to the exterior surface of the door.

* * * * *